US008870674B1

(12) United States Patent
Abbott

(10) Patent No.: US 8,870,674 B1
(45) Date of Patent: Oct. 28, 2014

(54) ADJUSTABLE GOLF CLUB

(71) Applicant: Callaway Golf Company, Carlsbad, CA (US)

(72) Inventor: Craig E. Abbott, Vista, CA (US)

(73) Assignee: Callaway Golf Company, Carlsbad, CA (US)

( * ) Notice: Subject to any disclaimer, the term of this patent is extended or adjusted under 35 U.S.C. 154(b) by 97 days.

(21) Appl. No.: 13/849,145

(22) Filed: Mar. 22, 2013

(51) Int. Cl.
*A63B 69/36* (2006.01)
*A63B 53/06* (2006.01)

(52) U.S. Cl.
CPC ..... *A63B 53/06* (2013.01); *A63B 53/065* (2013.01)
USPC ..... 473/238; 473/241; 473/242; 473/245; 473/246; 473/248; 473/251

(58) Field of Classification Search
CPC ..... A63B 69/36; A63B 69/3685; A63B 69/3676; A63B 53/06; A63B 53/0487; A63B 53/065; A63B 2053/023; A63B 2053/025; A63B 2053/026; A63B 2053/027; A63B 2053/0441
USPC ..... 473/244–248, 220, 221, 240, 241, 238, 473/242, 231, 305–315, 251–255
See application file for complete search history.

(56) References Cited

U.S. PATENT DOCUMENTS

| | | | | | |
|---|---|---|---|---|---|
| 651,920 | A * | 6/1900 | Cushing | 473/245 |
| 1,291,967 | A * | 1/1919 | McDougal | 473/251 |
| 1,657,972 | A * | 1/1928 | Rowe | 473/248 |
| 2,027,452 | A * | 1/1936 | Rusing | 473/246 |
| 2,067,556 | A * | 1/1937 | Wettlaufer | 473/308 |
| 2,155,830 | A * | 4/1939 | Howard | 473/246 |
| 2,219,670 | A * | 10/1940 | Wettlaufer | 473/247 |
| 2,326,495 | A * | 8/1943 | Reenstierna | 473/245 |
| 2,882,053 | A * | 4/1959 | Lorthiois | 473/245 |
| 4,082,286 | A * | 4/1978 | La Breche | 473/241 |
| 4,204,332 | A * | 5/1980 | Gray | 33/508 |
| 5,133,553 | A * | 7/1992 | Divnick | 473/245 |
| 5,533,730 | A * | 7/1996 | Ruvang | 473/251 |
| 5,538,245 | A * | 7/1996 | Moore | 473/239 |
| 5,597,362 | A * | 1/1997 | Lee et al. | 473/244 |
| 5,707,299 | A * | 1/1998 | McKenna | 473/241 |
| 5,722,177 | A * | 3/1998 | Reilly, III | 33/508 |
| 5,782,005 | A * | 7/1998 | Reilly, III | 33/508 |
| 6,213,889 | B1 * | 4/2001 | Hamburger | 473/245 |
| 6,623,372 | B1 * | 9/2003 | Beebe et al. | 473/231 |
| 7,172,513 | B1 * | 2/2007 | Rinker | 473/219 |

* cited by examiner

*Primary Examiner* — Sebastiano Passaniti
(74) *Attorney, Agent, or Firm* — Rebecca Hanovice; Michael A. Catania; Sonia Lari

(57) ABSTRACT

A golf club head having an adjustable hosel and a level is disclosed herein. The adjustable hosel is movable between a plurality of positions to adjust at least one feature of the golf club head, such as loft, lie, and/or face angle, and is held in place by an adjustment knob or adjustment lever. The level preferably is a bubble level that is disposed proximate a scale to indicate to a golfer an optimal loft, lie, and/or face angle of the golf club head.

6 Claims, 5 Drawing Sheets

ADJUSTABLE GOLF CLUB

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to an adjustable golf club. More specifically, the present invention relates to a golf club having measuring and adjustment features.

2. Description of the Related Art

The prior art discloses many different types of golf clubs, especially putter-type golf clubs. Although these inventions have disclosed various types of adjustability features for said golf clubs, the prior art has not provided a golf club head that allows for both measurement and adjustment of loft and lie angle features.

BRIEF SUMMARY OF THE INVENTION

The present invention provides a novel fitting mechanism for golf clubs. In particular, the present invention combines technology that measures loft, lie, and face angle, with technology that permits adjustments to be made to those features.

One aspect of the present invention is a golf club head comprising a body comprising a face, a top surface, a bottom surface, a heel, a toe, and a level, and an adjustable hosel, wherein the adjustable hosel is movable between a plurality of positions to adjust at least one feature of the golf club head. In some embodiments, the feature may be selected from the group consisting of lie angle, loft angle, and face angle. In other embodiments, the level may be disposed in the top surface of the body and may measure at least one feature of the golf club head, such as lie angle, loft angle, and face angle. In a further embodiment, the level may extend parallel to the face, and the top surface may comprise a scale.

In some embodiments, the adjustable hosel may be rotatably affixed to the body with a mechanical fastener, and in a further embodiment, the golf club may comprise an adjustment feature and a pointer affixed to the mechanical fastener. In still further embodiments, the adjustment feature may tighten and loosen the mechanical fastener, and the adjustment feature may be selected from the group consisting of a lever and a knob. In other embodiments, the adjustable hosel may comprise a scale. In still other embodiments, the golf club head may be selected from the group consisting of a wood-type golf club head, a hybrid-type golf club head, an iron-type golf club head, and a putter-type golf club head. In other embodiments, the level may be selected from the group consisting of a bubble level and a laser level.

Another aspect of the present invention is a golf club head comprising a body comprising a first upper surface, a face, a sole surface, a heel side, a toe side, and a bubble level, an adjustable hosel, and a mechanical fastener, wherein the bubble level is disposed in the first upper surface and extends from the heel side to the toe side parallel to the face, and wherein the mechanical fastener movably affixes the adjustable hosel to the body. In some embodiments, the body may further comprise a second upper surface, which may comprise a scale proximate and extending parallel to the bubble level. In other embodiments, the golf club head may further comprise an adjustment feature, which may be is affixed to the mechanical fastener, and which may be selected from the group consisting of a lever and a knob. Still other embodiments may further comprise a pointer, which may be non-rotatably affixed to the body proximate the adjustable hosel. In a further embodiment, the pointer may extend in a vertical direction perpendicular to the sole surface and be disposed parallel to the adjustable hosel. In a still further embodiment, the adjustable hosel may comprise a scale extending parallel to the sole surface, and the scale may be disposed proximate the pointer. In an alternative embodiment, the golf club head may further comprise at least one alignment marking on an uppermost surface of the body, which may be disposed approximately halfway between the heel side and the toe side and which may be disposed perpendicular to the face.

Yet another aspect of the present invention is a putter-type golf club head comprising a body comprising a first upper surface, a face, a sole surface, a heel side, and a toe side, a level, a hosel, a pointer, a mechanical fastener, and an adjustment knob, wherein the level is disposed in the first upper surface and extends from the heel side to the toe side parallel to the face, wherein the mechanical fastener connects the hosel to the body, wherein the hosel is movable along a plane that extends parallel to the face, wherein the adjustment knob semi-permanently fixes the hosel to the body, wherein the pointer extends in a vertical direction perpendicular to the sole surface and is non-rotatably affixed to the body proximate the hosel, and wherein the hosel comprises a scale extending parallel to the sole surface, and wherein the scale is located proximate the pointer. Some embodiments may further comprise at least one alignment marking on an uppermost surface of the body that may be disposed approximately halfway between the heel side and the toe side, and which may be disposed perpendicular to the face. In still other embodiments, the level may comprise a concave curvature.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
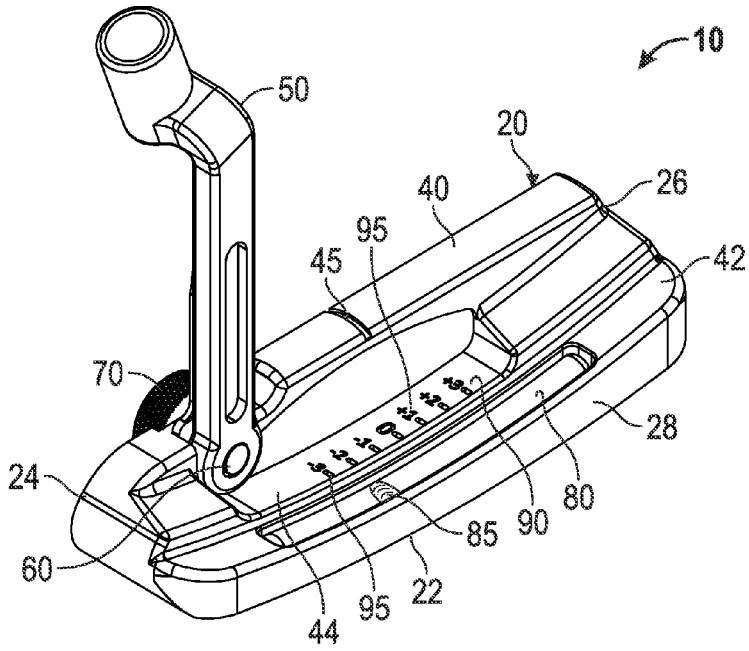
FIG. 1 is a rear perspective view of a first embodiment of the present invention.

The present invention is directed to a golf club head that includes a measurement feature for measuring loft, lie, and/or face angle, and an adjustable hose that permits adjustment to one or more of the golf club head's loft, lie, and/or face angle.

In a preferred embodiment, shown in FIGS. 1-6, the golf club head 10 of the present invention is a putter-type head comprising a body 20 having a sole surface 22, a heel end 24, a toe end 26, a rear end 28, a face 30, a top line 40, a first upper surface 42 located below the top line 40, and a second upper surface 44 located between the top line 40 and the first upper surface 42, a hosel 50 which is movably affixed to the body 20 with a mechanical fastener 60, and an adjustment knob 70 which, when tightened, semi-permanently fixes the hosel 50 to the body and, when loosened, permits the hosel 50 to move along a plane parallel to the face 30. The top line 40 preferably comprises an alignment feature 45, which in this embodiment is a notch but in alternate embodiments may be one or more lines or notches, to assist a golfer with lining up his or her shots.

Figure 5:
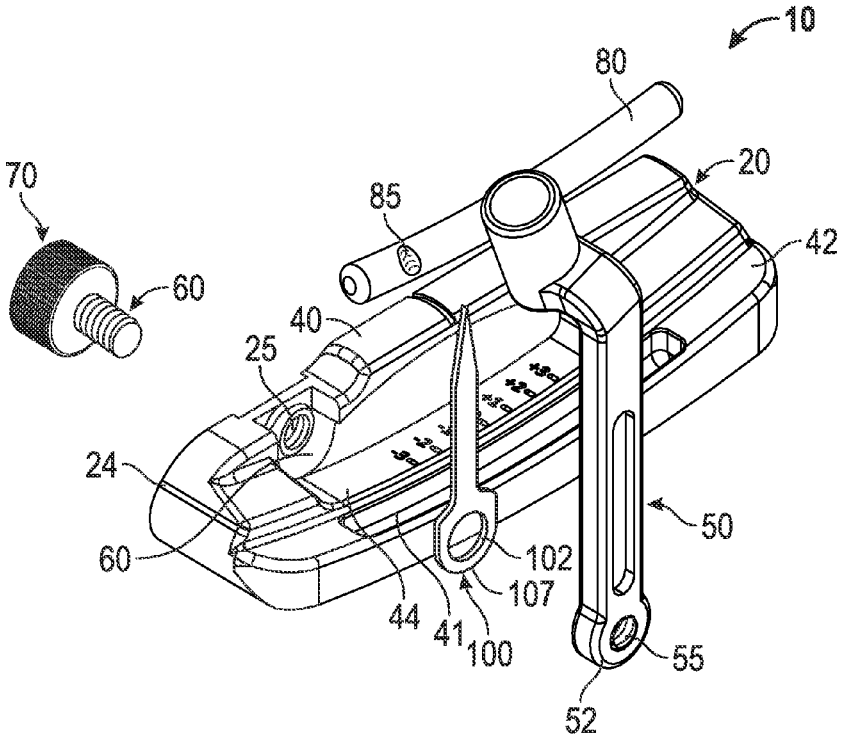
FIG. 5 is an exploded view of the embodiment shown in FIG. 1.
Figure 6:
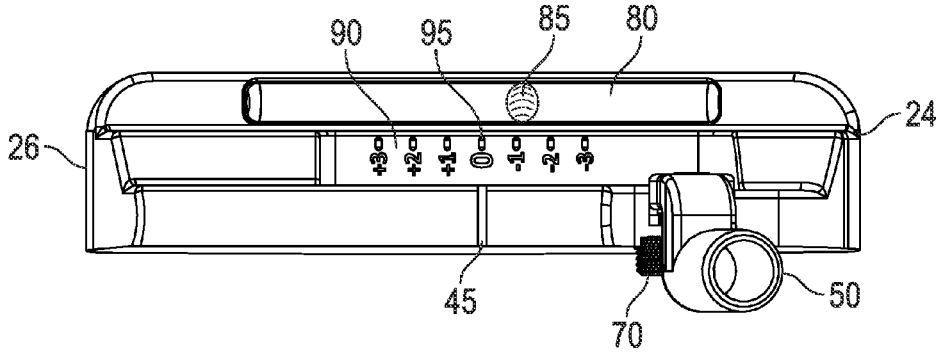
FIG. 6 is a top plan view of the embodiment shown in FIG. 1.
Figure 7:
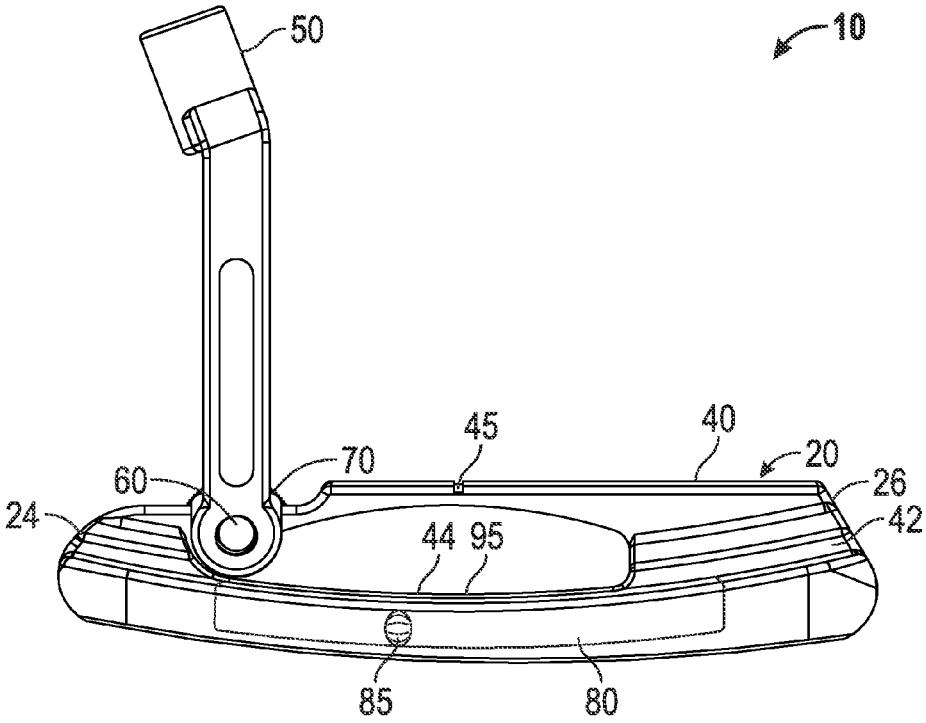
FIG. 7 is a rear plan view of the embodiment shown in FIG. 1 with the body in a transparent form so that the level is visible.

The golf club head 10 also comprises a level 80, which in this embodiment is a bubble 85 level but in other embodiments may be a laser or other type of level, which is disposed within a recess 41 in the first upper surface 42 and extends parallel to the face 30 from a location proximate the heel end 24 to a location proximate the toe end 26. As shown in FIGS. 5 and 7, the level 80 preferably curves to match the curvature of the body 20, and more preferably has a concave curvature. This allows the level 80 to better integrate into the overall structure of the body 20 and make the golf club head 10 look more aesthetically pleasing at address. A scale 90 is disposed on the second upper surface 44 proximate the level 80 to serve as a measurement reference, and preferably extends parallel the level 80 along most or all of its length so that the bubble 85 can be compared with one or more reference markings 95 no matter where the bubble 85 is disposed within the level 80.

Figure 2:
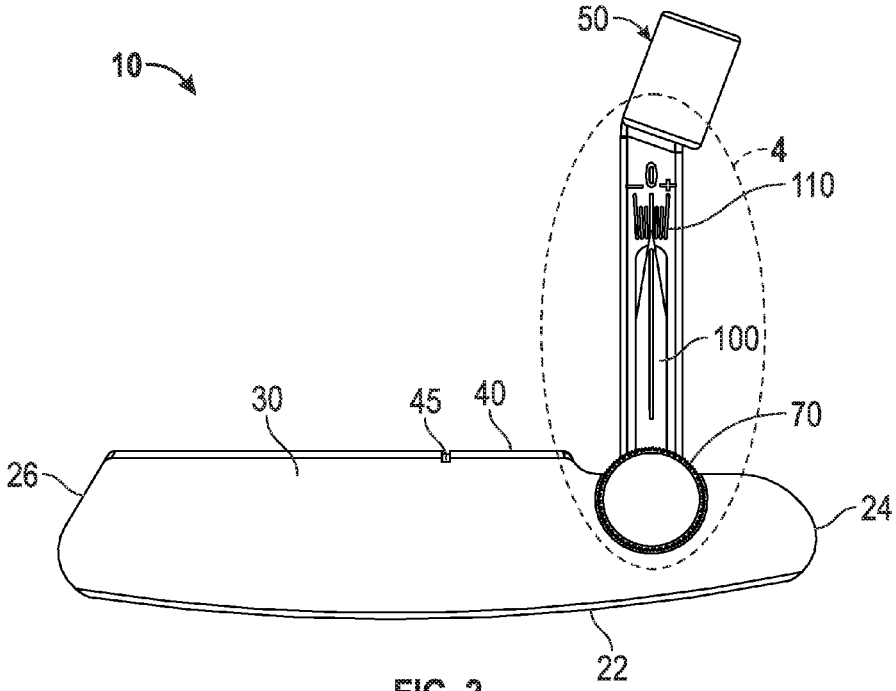
FIG. 2 is a front plan view of the embodiment shown in FIG. 1.
Figure 3:
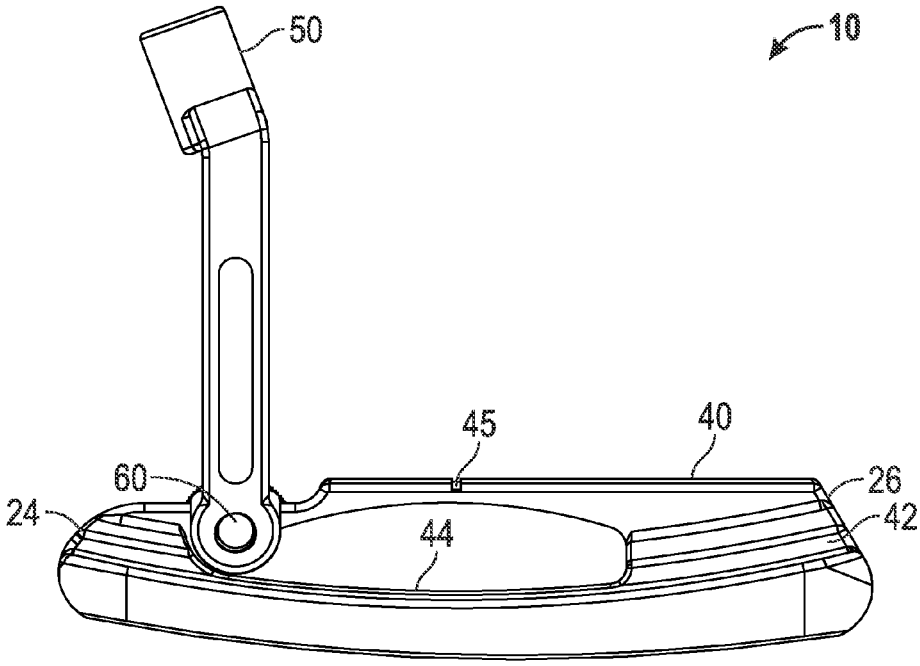
FIG. 3 is a rear plan view of the embodiment shown in FIG. 1.
Figure 4:
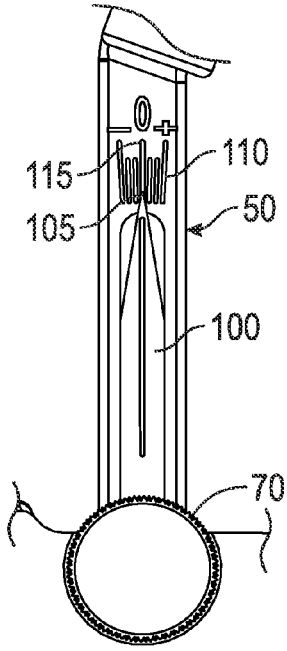
FIG. 4 is close up view of the circled part of the embodiment shown in FIG. 2.

As shown in FIGS. 2, 4, and 5 the golf club head 10 includes a pointer 100, which is affixed to the body 20 proximate the hosel 50 via the mechanical fastener 60, though in other embodiments the pointer 100 may be integrally formed or cast with the body 20 or permanently affixed via adhesive, welding, or another attachment method. The pointer 100 extends perpendicular to the sole surface 22, points in a vertical direction, and is slightly spaced from the hosel 50 so that the hosel 50 can move without making contact with the pointer 100. The hosel 50 preferably comprises a scale 110 on its external surface, and the scale 110 is disposed slightly above the pointer 100 when the golf club head 10 is fully assembled so that the top-most point 105 of the pointer 100 touches or nearly touches one of the markings 115 of the scale 110 when the hosel 50 is assembled with the body 20.

As shown in FIG. 5, the preferred embodiment preferably is assembled by permanently fixing the level 80 in the recess 41 of the first upper surface 42, preferably with an adhesive, gluing or integrally casting the adjustment knob 70 with the mechanical fastener 60 and threading the mechanical fastener 60 through a threaded through-bore 25 in the body 20 proximate the heel end 24, and then threading the pointer 100 and hosel 50 onto the mechanical fastener such that the pointer 100 is sandwiched between the hosel 50 and the body 20. An o-ring (not shown) may be disposed between the pointer 100 and the body 20 and/or the pointer 100 and the hosel 50 to prevent unwanted friction between these pieces during use. The pointer preferably has a bore 102 located in its lowermost portion 107 sized to receive the mechanical fastener 60, and the hosel 50 also has a threaded bore 55 proximate its lowermost end 52 to receive the mechanical fastener 60. A nut (not shown) may be affixed to the mechanical fastener 60 at the rear side of the hosel 50 once all of the pieces are assembled to secure the pieces to each other. In alternative embodiments, the level 80 may be removably fixed within the recess 41, and may in other embodiments be permanently or semi-permanently fixed in the recess 41 using mechanical fasteners, glues, and other means known to a person skilled in the art. In still other embodiments, the adjustment knob 70 may face in a rearward direction so that it is hidden from view when the golf club head 10 is viewed from the face 30 side.

In the preferred embodiment of the present invention, a golfer can determine the optimal lie of his or her golf club head 10 when he or she holds it at address by comparing the bubble 85 in the level 80 with the scale 90. The location of the bubble 85 with respect to a marking 95 on the scale 90 indicates to the user the preferred lie angle for the golf club head 10 at address. The user then can loosen the adjustment knob 70, move the hosel 50 along a plane parallel to the face 30 until the top-most point 105 of the pointer 100 points to or touches the matching marking 115 on the hosel 50 scale 110. The adjustment knob 70 is then tightened and the golfer has a club that is better fitted to his or her stance, grip, and/or performance.

Figure 8:
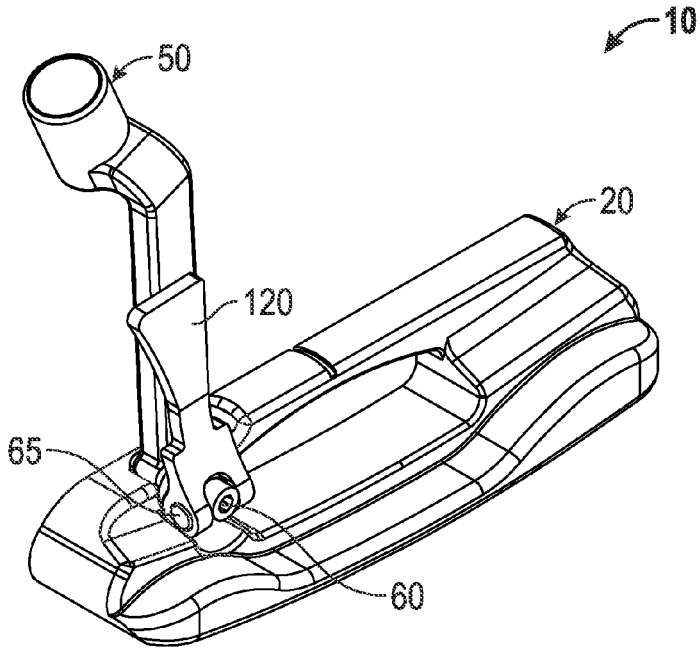
FIG. 8 is a rear perspective view of a second embodiment of the present invention.
Figure 9:
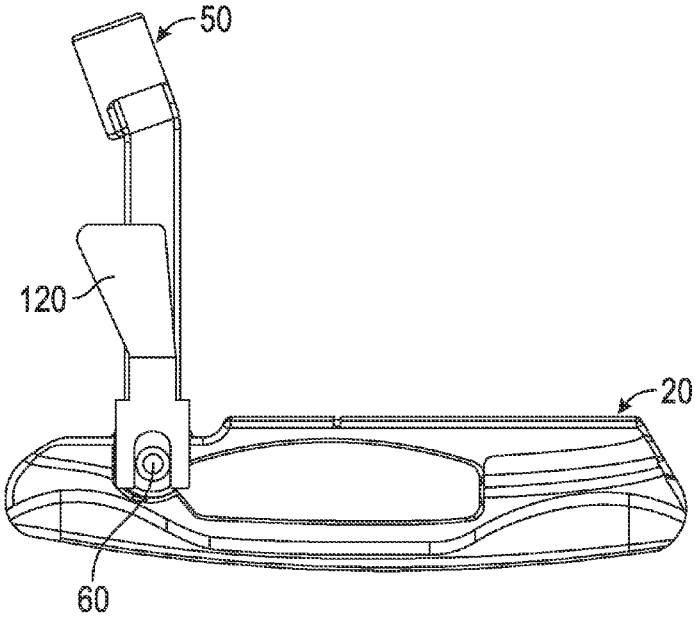
FIG. 9 is a rear plan view of the embodiment shown in FIG. 8.
Figure 10:
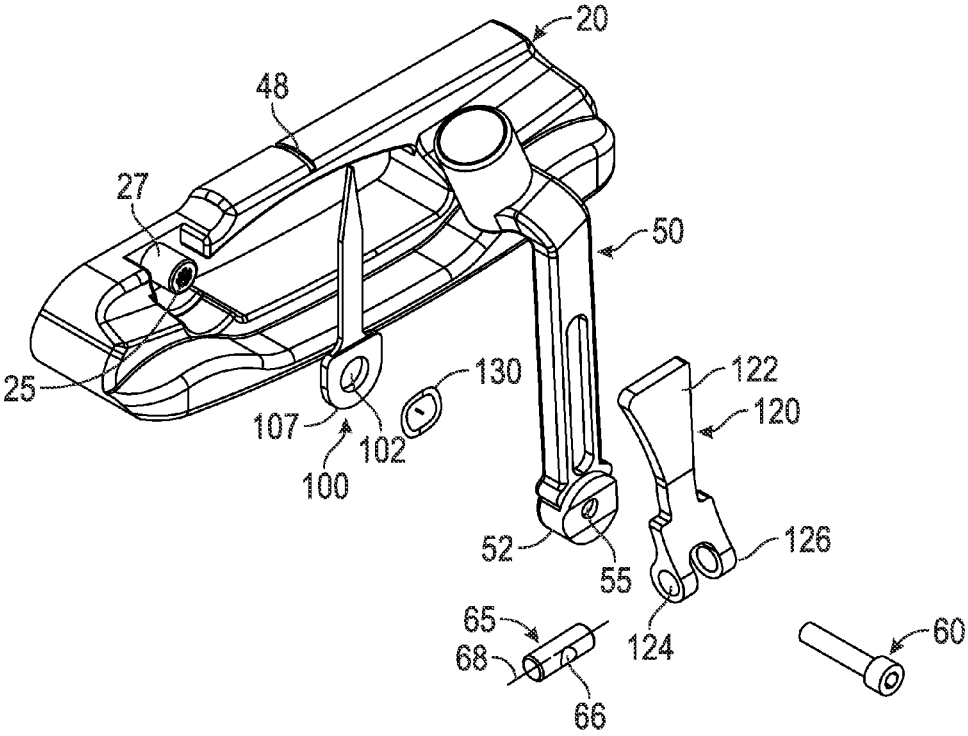
FIG. 10 is a bottom, perspective, exploded view of the embodiment shown in FIG. 8.

A second embodiment of the present invention is shown in FIGS. 8-10. In this embodiment, the golf club head 10 has many of the features of the preferred embodiment except for the scale 90 and the bubble 85 level 80, but instead of an adjustment knob 70, the golf club head 10 includes an adjustment lever 120, the threaded through-bore 25 extends through a rearward-facing projection 27, and the mechanical fastener 60 is a bolt. The adjustment lever 120 comprises a flange 122 and a through-bore 124 at its lower-most portion 126, the through-bore 124 sized to receive a pivot pin 65, which includes a through hole 66 that receives the mechanical fastener 60.

This embodiment of the present invention is assembled as shown in FIG. 10. The rearward-facing projection 27 is threaded through a bore 102 in the lowermost portion 107 of the pointer 100, then threaded through an o-ring 130, and abuts the threaded bore 55 in the lowermost end 52 of the hosel 50. The pivot pin 65 is snugly received in the through-bore 124 of the adjustment lever 120, and then the mechanical fastener 60 is inserted into the hole 66 in the pivot pin 65 to engage the threaded bore 55 of the hosel 50 and the threaded through-bore 25 of the body 20. When the flange 122 of the adjustment lever 120 is pulled downwards away from the hosel 50, the pivot pin 65 pivots around its horizontal axis 68 and pulls the mechanical fastener 60 away from the hosel 50, thus releasing the pressure placed on the hosel 50 and permitting it to move. Once the hosel 50 is adjusted to a preferred location, the flange 122 of the adjustment lever 120 can be pushed up so the adjustment lever 120 is parallel with the hosel 50, thus re-engaging the mechanical fastener 60 with the other pieces of the golf club head 10 and semi-permanently fixing the hosel 50 in place.

Although shown in connection with a putter head in the Figures and embodiments herein, the invention disclosed herein may be used in connection with other golf club head types, including drivers, fairway woods, hybrids, irons, and wedges. Some embodiments of the present invention may only include one of the features disclosed herein, e.g., a golf club head of the present invention may include only the level 80 feature or the hosel 50, which may be adjustable either with an adjustment knob 70 or an adjustment lever 120. Still other embodiments may allow for adjustment to loft angle, with the hosel 50 attached to the body 20 through the heel side 24 such that the hosel 50 is adjustable along a plane perpendicular to the face 30. In these embodiments, the level 80 may also extend perpendicular to the face 30 and may be used to determine an optimal loft angle for a particular golfer. Still other embodiments may allow for adjustment to face angle.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim:

1. A putter-type golf club head comprising:

a body comprising a first upper surface, a face, a sole surface, a heel side, and a toe side;

a level;

a hosel;

a pointer;

a mechanical fastener; and an adjustment knob, wherein the level is disposed in the first upper surface and extends from the heel side to the toe side parallel to the face, wherein the mechanical fastener connects the hosel to the body, wherein the hosel is movable along a plane that extends parallel to the face, wherein the adjustment knob semi-permanently fixes the hosel to the body, wherein the pointer extends in a vertical direction perpendicular to the sole surface and is non-rotatably affixed to the body proximate the hosel, and wherein the hosel comprises a scale located proximate the pointer.

2. The putter-type golf club head of claim 1, wherein the level and measures at least one feature of the golf club head, wherein the at least one feature is selected from the group consisting of lie angle, loft angle, and face angle.

3. The putter-type golf club head of claim 1, wherein the level is selected from the group consisting of a bubble level and a laser level.

4. The putter-type golf club head of claim 1, wherein the body further comprises a second upper surface, and wherein the second upper surface comprises a scale proximate and extending parallel to the level.

5. The putter-type golf club head of claim 1, further comprising at least one alignment marking on an uppermost surface of the body, wherein the at least one alignment marking is disposed approximately halfway between the heel side and the toe side, and wherein the at least one alignment marking is disposed perpendicular to the face.

6. The putter-type golf club head of claim 1, wherein the level comprises a concave curvature.

* * * * *